United States Patent [19]

Weisgerber et al.

[11] 4,085,930

[45] Apr. 25, 1978

[54] SHEET DELIVERY MECHANISM FOR SHEET FED PRINTING MACHINES

[75] Inventors: Willi Weisgerber, Johannisberg-Rheingau; Ernst Federhen, Ingelheim am Rhein, both of Germany

[73] Assignee: Miller Western Corporation, Pittsburgh, Pa.

[21] Appl. No.: 727,337

[22] Filed: Sep. 28, 1976

[30] Foreign Application Priority Data

Oct. 4, 1975 Germany ..... 2544566

[51] Int. Cl.[2] ..... B65H 29/04; B65H 31/20

[52] U.S. Cl. ..... 271/204; 271/183; 271/223

[58] Field of Search ..... 271/182, 183, 194, 195, 271/198, 204–206, 211, 223, 224

[56] References Cited

U.S. PATENT DOCUMENTS

| | | | |
|---|---|---|---|
| 2,969,980 | 1/1961 | Claybourn | 271/183 |
| 3,081,082 | 3/1963 | Spooner et al. | 271/183 |
| 3,136,541 | 6/1964 | Peyrebrune | 271/223 X |

FOREIGN PATENT DOCUMENTS

| | | | |
|---|---|---|---|
| 280,502 | 1/1952 | Switzerland | 271/204 |

*Primary Examiner*—Robert W. Saifer

[57] ABSTRACT

A frame member extends from the last printing unit of a printing machine to a table upon which the freshly printed sheets are piled. A plurality of spaced endless chains are reeved about idler sprockets positioned adjacent the printing unit at one end and about driven sprockets at the other end where the printed sheets are stacked in a pile. Transversely extending gripper bars are secured to the chains and pass with the chains along a continuous path from the printing unit to the pile over a sheet guide assembly. The upper end portion of the sheet guide assembly is supported by bearing assemblies which also support a plurality of suction wheels that are positioned between the upper end of the sheet guide assembly and the pile. Actuating devices advance the bearing assemblies toward and away from the pile to thereby position the sheet guide assembly and the suction wheels for depositing a sheet of a selected size onto the pile. Movement of the leading edge of a sheet over the sheet guide assembly creates a continuous cushion of air from the printing unit to the end of the sheet guide assembly. The cushion of air supports the freshly printed sheet above the guide assembly and removed therefrom to prevent smearing of the sheet. The printed sheet passes from the upper end of the guide assembly onto the periphery of the suction wheels which slow the movement of the sheet and exert a downward force upon the trailing edge of the sheet to prevent interference with the next following sheet and contact with any rigid surface that could smear the freshly printed sheet.

10 Claims, 7 Drawing Figures

SHEET DELIVERY MECHANISM FOR SHEET FED PRINTING MACHINES

BACKGROUND OF THE INVENTION

1. Field of the Invention

This invention relates to a sheet feeding mechanism and more particularly to a sheet feeding mechanism having a sheet guide assembly for delivering freshly printed sheets from the last printing unit of the press to a pile of sheets without smearing the ink.

2. Description of the Prior Art

In delivering freshly printed sheets from the last printing unit of a printing press to a pile it is essential that the damp sheet be maintained out of contact with a solid surface during the delivery to prevent smearing of the ink. Smearing of the ink commonly occurs on the underside of the sheet when the sheet comes in contact with any of the guide elements that serve to guide the sheet along the path from the last printing unit to the pile. The guide elements are necessary to assure that the freshly printed sheets transported by the gripper mechanisms secured to rotating chains be deposited in proper register on the pile. In order to accommodate variations of sheet length, the guide elements must maintain the movement of the sheets along a directed path and over suction devices. For this reason to meet the variations in the sheet length the guide elements and the suction devices are adjustable in the direction of the sheet movement, i.e., toward and away from the pile.

It is known to direct the movement of the freshly printed sheets along a prescribed path by drive elements such as strings tensioned by weights, tail wheels, slim rods, bands or the like. However, inherent in these types of guide elements is the disadvantage that the printed sheet comes in contact with the guide elements and is therefore smeared before it has had an opportunity to dry. Furthermore, adjustments to these guide elements to accommodate a change in the sheet length is time consuming necessitating stopping of the printing process. Because the above known types of guide elements are effective only linearly wrinkling and creasing of the sheets is common requiring stopping the press in order to make the necessary correction.

There is a need for a sheet delivery mechanism where the printed sheets are taken from the last printing unit by gripper mechanisms that are rotated in a direction from the printing unit to a pile of sheets and where along the path of delivery the freshly printed sheets are maintained from contact with a rigid surface to prevent smearing and are also moved along a path which is adjustable in length to accommodate a variation in length of the sheet being delivered.

SUMMARY OF THE INVENTION

In accordance with the present invention there is provided a sheet delivery mechanism that includes a frame member supported in overlying relation with a pile of sheets. A plurality of chains are positioned in spaced relation to each other and supported for rotation on the frame member above the pile of sheets. Gripper devices are secured to and extend between the endless chains and are operable to engage the leading edge of a sheet. The sheet is conveyed upon rotation of the endless chains to the pile of sheets. When positioned in overlying relation with the pile, the sheet is released by the gripper devices to fall on the pile. Suction devices extend transversely between the frame member and are positioned adjacent the pile of sheets. The suction devices slow the movement of the sheet as the sheet is being delivered to the pile. A sheet guide assembly is mounted on the frame member and extends forwardly from the suction devices from a position adjacent thereto in a continuous, uninterrupted surface. The surface of the sheet guide assembly is maintained closely spaced from a sheet such that movement of the sheet forms an air cushion above the sheet guide assembly and extending to the suction devices. With this arrangement the air cushion thus formed serves to maintain the sheet removed from contact with the sheet guide assembly as the sheet is being delivered to the pile of sheets.

The gripper mechanisms include a plurality of gripper bars extending transversely between the chains and are secured at their end portions to the chains. The gripper bars engage the leading edge of the sheet and pass the sheet over the guide assembly along the rotating path of the chains. The gripper bars are positioned closely adjacent to the sheet guide assembly that includes a continuous, noninterrupted surface so that the movement of a sheet relative to the surface generates an air cushion between the sheet guide assembly and each sheet to hold the sheet afloat and out of contact with the sheet guide assembly.

With the guide assembly having a continuous surface without interruptions or gaps, the air cushion similarly is continuous and noninterruptive between the guide assembly and the sheet to prevent the sheet from touching the guide assembly and smearing the freshly printed sheet before it is allowed to dry. Thus, a sheet from the time it is engaged by the gripper mechanisms and transported from the delivery cylinder of the last printing unit of the press to the pile of sheets, the sheet is maintained removed from contact with the guide assembly by the cushion of air established over the surface of the guide assembly. The freshly printed sheet is delivered to the pile of sheets without smearing the damp sheet during the delivery process.

The sheet guide assembly in one embodiment may include a pair of overlying sheet guide plates, one fixed to the frame and one movable relative to the frame. An upper sheet guide plate is fixed on the frame and extends from a lower end portion positioned rearwardly of the delivery cylinder to an upper end portion spaced from the suction devices. A lower sheet guide plate of the sheet guide assembly extends from a position substantially forward from the lower end portion of the upper guide plate in an arcuate path and is movably supported at its upper end portion on the machine frame to provide an adjustment of the sheet guide assembly in accommodating sheets of varying lengths from a minimum to a maximum length.

The upper end portion of the lower sheet guide plate is secured to a stiffener bar that is mounted at the end portions thereof on a bearing assembly that also supports suction devices. The suction devices may include a plurality of suction wheels that extend transversely relative to the direction of sheet movement. The bearing assemblies are movable toward and away from the pile of sheets by an actuating mechanism such that for delivering sheets of a minimum length, the suction wheels and the lower sheet guide plate are advanced toward the pile. On the other hand, in order to accommodate a sheet of maximum length, the bearing assemblies are advanced away from the pile to position the suction wheels and the lower sheet guide plate in the preferred position for delivery of a sheet of maximum length.

In another embodiment of the guide assembly, a single sheet guide plate is provided on the frame and extends between the delivery cylinder and the connection of the upper end portion of the single guide sheet plate to the movable bearing assemblies. Similarly, to the pair of sheet guide plates, the single guide sheet plate has a continuous uninterrupted surface upon which is created the cushion of air to float the sheet above the respective sheet guide plate during delivery of the freshly printed sheet to the pile. As with the lower sheet guide plate of the pair of plates, the single sheet guide plate is also movable toward and away from the pile by movement of the bearing assemblies on the machine frame member.

Each sheet guide plate of the sheet guide assembly is free of obstacles such as waves, blisters or other uneveness or roughness, which would tend to break the cushion of air maintained above the sheet guide plate and result in contact of the freshly printed sheet with the plate and smearing of the ink. Further, in order to prevent contact of a freshly printed sheet with a sheet guide assembly, the suction wheels are positioned forwardly of the upper end portion of the sheet guide assembly with the periphery of the suction wheels maintained above the upper surface of the sheet guide assembly. The trailing edge of the sheet is engaged on the periphery of the suction wheels and therefore does not come in contact with the next following sheet or the guide assembly. Further, to this end an air box fed with compressed air having a chamber open to the underside of the sheet guide assembly by nozzels directs a flow of air away from the direction of sheet movement. The flow of air creates an area of reduced pressure or suction in the space between the suction wheels and the upper end portion of the guide assembly. As the sheet is delivered by the chains above the sheet guide assembly and passes over the suction wheels, the trailing edge of the sheet is pulled downwardly into contact with the suction wheels to permit delivery of the leading edge of the next succeeding sheet into contact with the wheel without contacting the trailing edge of the preceeding sheet.

Accordingly, the principal object of the present invention is to provide a sheet delivery mechanism for delivering freshly printed sheets from the last printing unit of a press to a pile of sheets where the sheets are transported on a cushion of air to prevent the sheets from contacting a solid surface and smearing the freshly printed ink.

Another object of the present invention is to provide a sheet delivery mechanism having a plurality of gripper mechanisms for engaging the leading edge of a freshly printed sheet and transporting the sheet over a sheet guide assembly such that the movement of the sheet generates a cushion of air to prevent contact of the sheets by the guide assembly with suction devices for exerting a breaking force on the sheet prior to depositing the sheet on the pile after being released by the gripper mechanisms.

Another object of the present invention is to provide a sheet guide assembly for a sheet delivery mechanism over which sheets are transported by gripper bars and maintain removed from contact therewith by a cushion of air where the sheet guide assembly is movably supported on the machine frame to accommodate the delivery of sheets of variable length to the pile.

Another object of the present invention is to provide a sheet guide assembly for a sheet delivery mechanism having a continuous, uninterrupted surface over which a sheet is transported and which movement by gripper bars creates an uninterrupted air cushion along the entire length of the sheet guide assembly so that the freshly printed sheets are deposited on the pile without smearing the ink.

These and other objects of the present invention will be more completely disclosed and described in the following specification, the accompanying drawings and the appended claims.

DESCRIPTION OF THE PREFERRED EMBODIMENT

Figure 1:
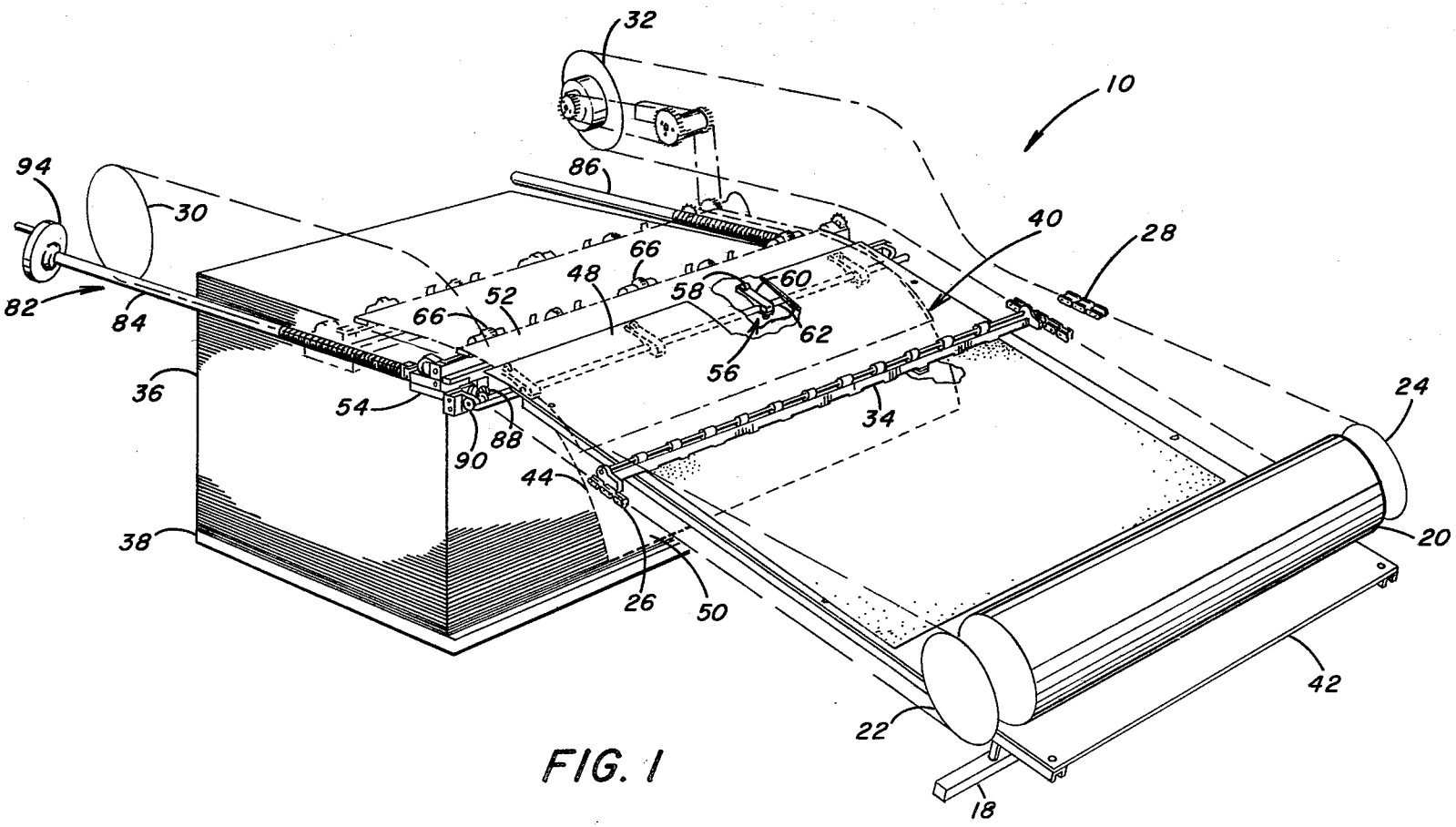
FIG. 1 is a schematic perspective view of a sheet delivery mechanism, illustrating a sheet guide assembly having a lower guide plate shown in a first position designated by - - - lines for delivering sheets of maximum length to a pile and the lower guide plate shown in a second position designated by - . - lines for delivering sheets of minimum length to the pile.
Figure 2:
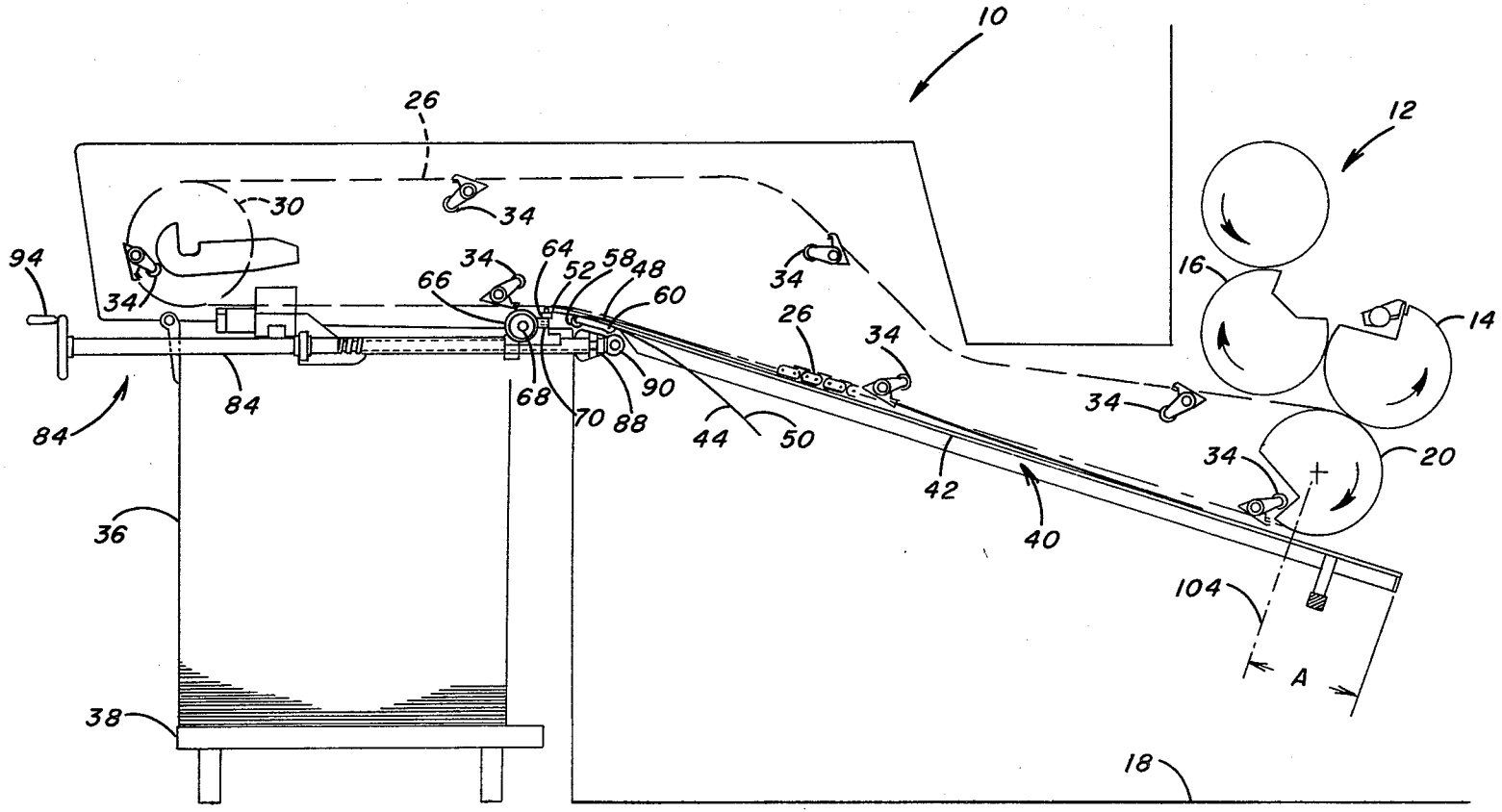
FIG. 2 is a view in side elevation of FIG. 1, illustrating the lower sheet guide plate adjusted for delivering a sheet of maximum length to the pile.

Referring to the drawings and particularly to FIGS. 1–4, there is schematically illustrated a sheet delivery mechanism generally designated by the numeral 10 that is positioned adjacent to the delivery end of a printing press having a printing unit generally designated by the numeral 12 that includes, as illustrated in FIG. 2, an impression cylinder 14 and a blanket cylinder 16 mounted in a machine frame 18. A delivery cylinder 20 is supported in the machine frame 18 below the impression cylinder 14 and supports a pair of sprockets 22 and 24 illustrated in FIG. 1, about which are reeved endless chains 26 and 28. The opposite ends of the chains 26 and 28 pass around sprockets 30 and 32 which may be driven sprockets and the sprockets 22 and 24 being idler sprockets.

A plurality of gripper bars 34 are connected transversely to the spaced chains 26 and 28. The gripper bars 34, as well known in the art, include grippers having adjustable cams for releasing a sheet over a pile of sheets at the delivery end of the press. The grippers are arranged to engage the leading edge of a sheet positioned on the impression cylinder 14 which sheet is printed on the outer surface by the blanket cylinder 16. The grippers on the gripper bars 34 convey the sheet along the path indicated by the chains 26 and 28 to the sprockets 30 and 32 in overlying relation with a pile of sheets 36 on a stacking table 38. When the printed sheets secured to the gripper bars 34 pass in overlying relation with the pile of sheets 36 the adjustable cams of the grippers are opened to release the front edge of the sheet and deposit the sheet on the pile 36.

A sheet guide assembly generally designated by the numeral 40 is supported on the machine frame 18 forwardly of the pile 36. The chains 26 and 28 pass in spaced relation above the sheet guide assembly 40 which may include in one embodiment a pair of spaced overlying plate members 42 and 44. As illustrated in FIGS. 1 and 2, the upper plate member 42 is fixed to the machine frame 18 and extends from a position underlying the delivery cylinder 20 in the direction of sheet movement at its lower end portion to a position spaced from the pile 36 at its upper end portion. The lower plate member 44 of the sheet guide assembly 40 is positioned for movement in the direction of travel of the printed sheets from the printing unit 10 to the pile 36 and extends in an arcuate path upwardly from a lower end portion adjacent the delivery cylinder 20 to a position spaced from the pile 36 but extending forwardly of the upper end portion of the plate member 42.

The lower sheet guide plate 44 is movable on the machine frame 18, in a manner to be later explained, to permit adjustments in the sheet delivery apparatus for the transfer of printed sheets of various size from the printing unit 12 to the pile 36. The sheet guide plates 42 and 44 are positioned in abutting relation adjacent the pile 36 with the upper end portion of plate 44 extending beyond plate 42 toward the pile and the lower end portion of plate 42 extending beyond the lower end portion of plate 44 toward the delivery cylinder 20, as illustrated in FIG. 2. With this arrangement a continuous, uninterrupted surface is provided over which a sheet travels from the last printing unit 12 to the pile 36.

The movement of a sheet upon rotation of chains 26 and 28 from the sprockets 22, 24 to sprockets 30, 32 creates an air cushion that maintains the sheet displaced from contact with both plates 42 and 44 such that the sheet in essence floats above the sheet guide plates 42 and 44 to prevent smearing of the freshly printed sheet by contact with one of the sheet guide plates as it is being transferred from the printing unit 12 to the pile 36. The air cushion is located in the gap between the chains 26 and 28 and the plates 42 and 44. It is essential that the air cushion in the gap be continuous along the length of the guide plate assembly 40 without interruption which would occur if there were an interruption in the surface of one of the sheet guide plates 42 or 44. If such a gap existed the air cushion between the sheet guide plates and the chains would be broken, and the freshly printed sheet would contact the respective sheet guide plate smearing the wet ink on the sheet. Therefore, to prevent contact of a freshly printed sheet with the sheet guide assembly a gapless transfer must be maintained along the direction of sheet movement between the chains 26 and 28 and the upper and lower sheet guide plates 42 and 44. Thus, the respective guide plates must be continuous in length and substantially smooth without interruption.

Figure 7:
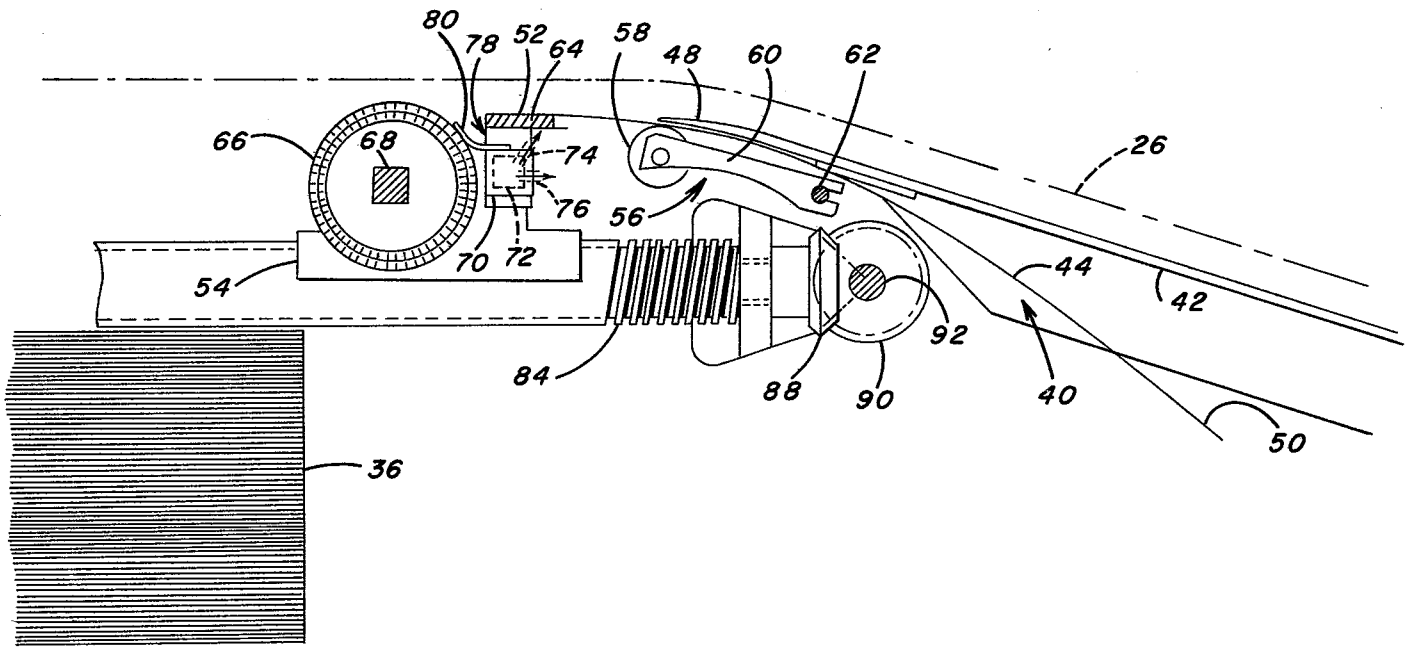
FIG. 7 is an enlarged fragmentary view in side elevation of the sheet guide assembly and a suction wheel moved to the position on the machine frame for delivering sheets of maximum length to the pile.

As illustrated in FIG. 1 and in greater detail in FIG. 7, the upper sheet guide plate 42 is immovably positioned on the machine frame 18 and includes an arcuate upper end portion 48. The lower sheet guide plate 44, on the other hand, is supported for longitudinal movement on the machine frame 18 in the direction of sheet travel toward and away from the pile 36. The sheet guide plate 44 includes an arcuate lower end portion 50 and extends upwardly therefrom to the pile 36. The lower sheet guide plate 44 extends beyond the upper end portion 48 of plate 42 and has an upper end portion 52 spaced from the upper end portion 48. The upper end portion 52 is secured to a bearing assembly, generally designated by the numeral 54 and illustrated in FIG. 3, that is movable on the machine frame 18 in the direction of sheet movement. The sheet guide plate 44 is preferably constructed of a flexible metal plate as is the sheet guide plate 42.

Referring to FIG. 7, the sheet guide plate 44 adjacent the upper end portion 52 thereof is pressed into contact with the upper end portion 48 of plate 42 by a support device generally designated by the numeral 56 that includes a plurality of support rollers 58 that are carried on support levers 60. The support levers are secured at the opposite end to a support shaft 62 that extends in underlying relation with the sheet guide plate 44 and is securely mounted on the machine frame 18. The rollers 50 maintain the plate 44 in contact with plate 42 to assure a continuous, uninterrupted surface for the delivery of a sheet.

Figure 3:
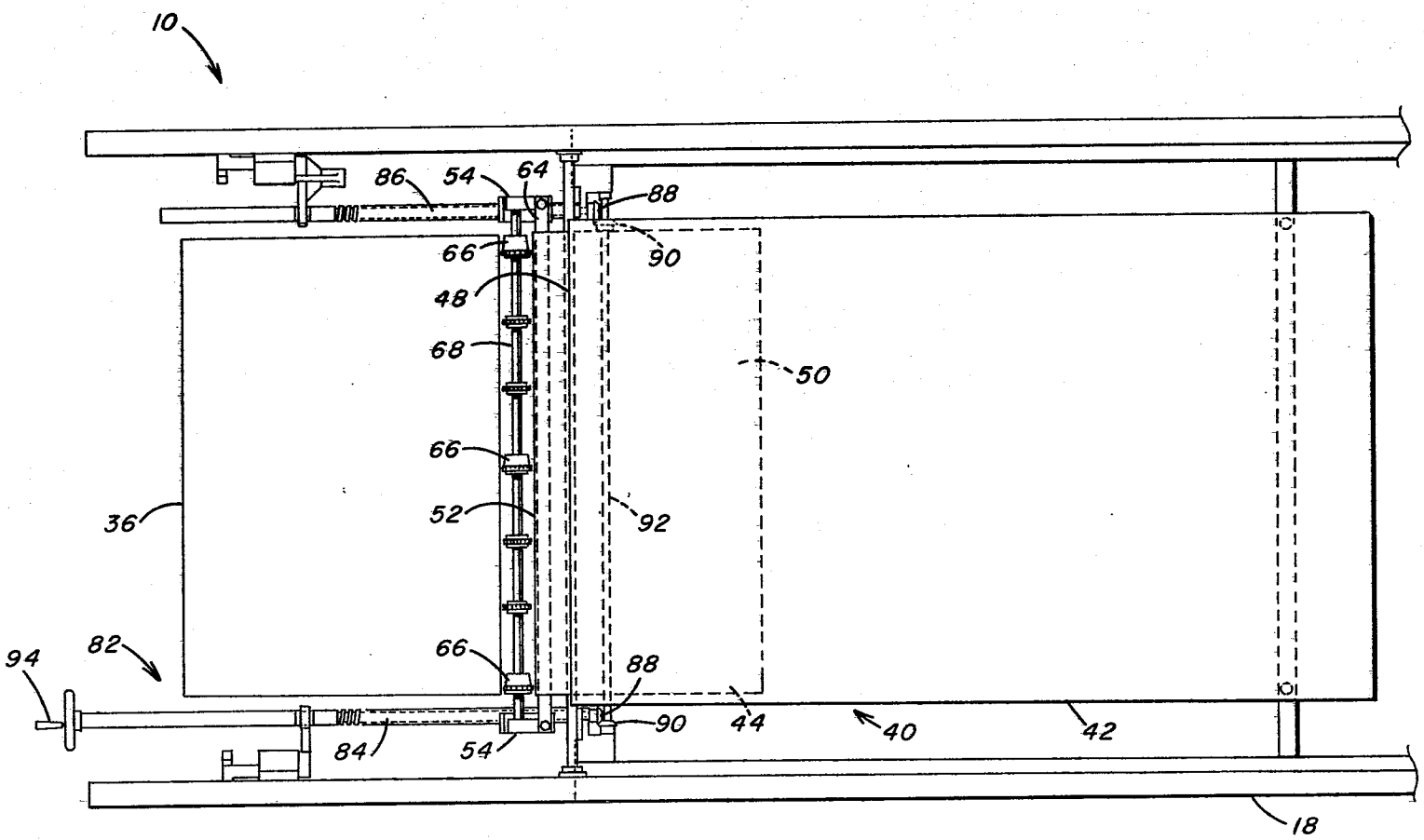
FIG. 3 is a top plan view of the embodiment of the invention illustrated in FIG. 2.
Figure 4:
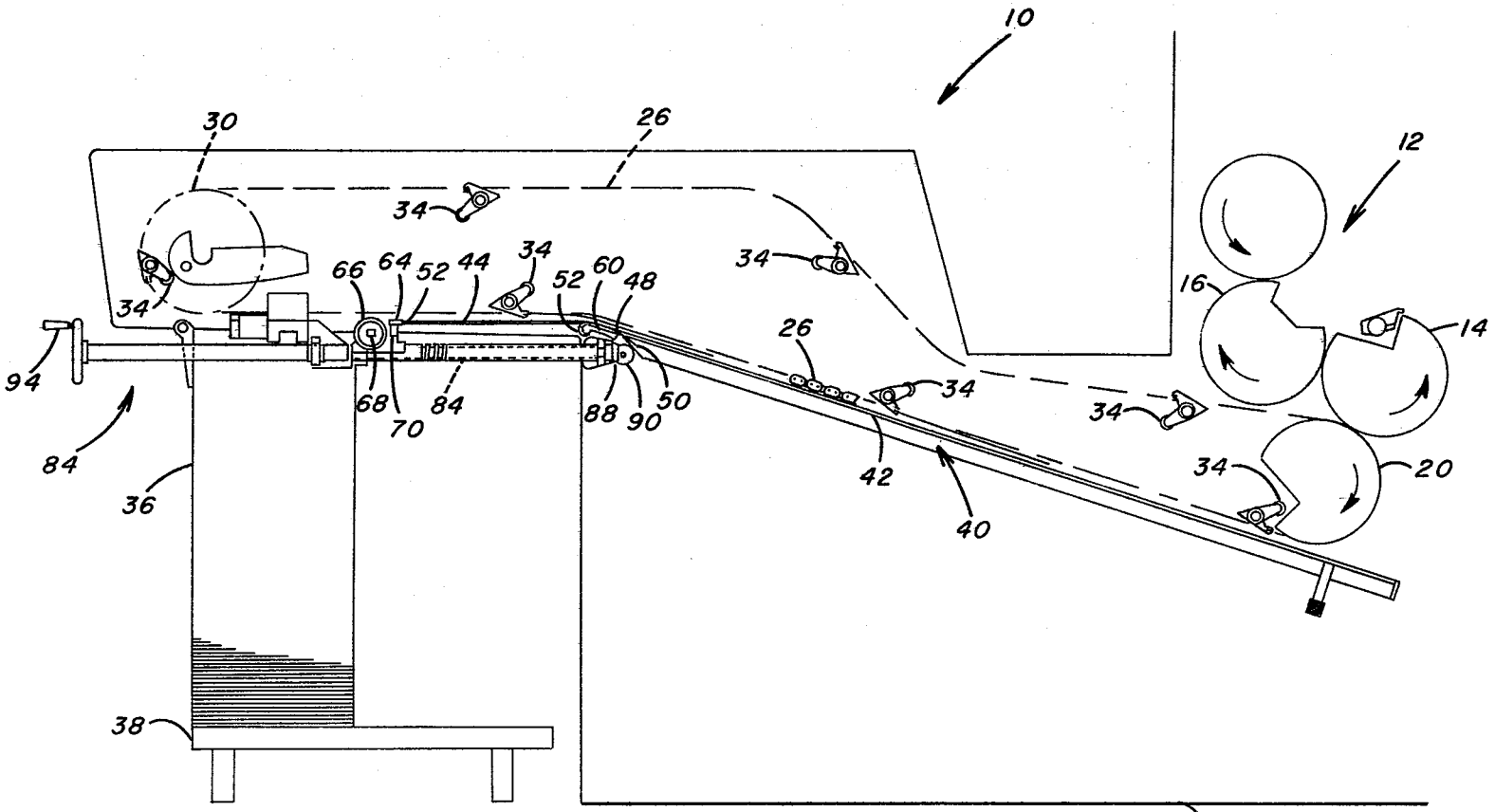
FIG. 4 is a view in side elevation of the sheet delivery mechanism, illustrating the lower sheet guide plate adjusted for transferring a printed sheet of minimum length to the pile.

The upper end portion 52 of guide plate 44 is secured to the bearing assemblies 54 mounted to the machine frame 18 adjacent the pile 36 by a stiffener bar 64. The stiffener bar 64, as illustrated in FIG. 3, extends transverse to the direction of sheet movement and is secured at its end portions to the bearing assemblies 54. The sheet guide plate end portion 52 is bent over, around and underneath the stiffener bar 64 and may be suitably secured thereto by an adhesive.

A plurality of suction devices 66 are also supported by the bearing assemblies 54 for longitudinal movement in the direction of sheet movement. The suction devices 66 may include a plurality of suction wheels. As illustrated in FIGS. 3 and 7, the suction wheels 66 are mounted on a shaft 68 that is suitably journaled in the bearing assemblies 54. The suction wheels 66 are operable to apply a retarding force to a sheet as it advances from the sheet guide assembly 40 to the pile 36 with the effect of slowing or breaking the velocity of the sheet as it is being advanced by the chains. With this arrangement the sheet is prevented from hitting the front sheet stop associated with the stacking table 38 with a velocity that would damage the printed sheet. To this end the peripheral speed of the suction wheels 66 that are selectively spaced on the shaft 68 is less than the velocity of the sheet carried by the chains, as is well known in the art.

It is essential that the periphery of the suction wheels 66 extend above the upper surface of the sheet guide plate end portion 52. With this arrangement the sheet is securely seized by the suction wheels 66 and maintained from contact with that portion of the guide plate 44 that is secured to the stiffener bar 64. This further assures that the freshly printed sheet will not be smeared as the sheet is transferred from the last printing unit 12 of the press to the pile of sheets 36.

As illustrated in FIG. 7, the bearing assemblies 54 that support the suction wheel shaft 66 also supports an air box 70 having a chamber 72 into which is fed compressed air from a source. The air box is positioned transversely to the movement of the sheet from the printing unit 12 to the pile 36 on the bearing assemblies 54. The air box 70 includes a plurality of nozzels or air exit openings 74 and 76. Compressed air is directed from the chamber 72 and out the exits 74 and 76 in the direction indicated by the arrows in FIG. 7. As illustrated the direction of air flow from the air box 70 is against the direction of sheet movement and is also directed upwardly toward the sheet guide plate 44. The air box 70 is preferably located on the bearing assemblies 54 in underlying relation with the stiffener bar 64 and the upper end portion 52 of plate 44.

The air box 70 is operable to generate a stream of air between the suction wheels 66 and the stiffener bar 64 in a direction indicated by arrow 78 opposite to the direction of sheet movement. Air flow in this direction creates a partial vacuum or area of reduced pressure on the upper surface of the plate end portion 52. Thus a sheet to be released by the grippers of the gripper bars 34 on the pile 36 is pulled downwardly, as in an injector effect. With this effect the leading edge of a sheet as it passes from the guide plate upper edge 52 is pulled firmly down onto the suction wheels 66. As the trailing edge of the sheet passes over the upper edge portion 52, the edge is also pulled down behind the suction wheels 66 to assure contact with the periphery thereof. In addition this operation assures that the leading edge of a subsequent sheet does not contact the trailing edge of a preceeding sheet. Also a continuous short guide plate 80 is positioned between the upper surface of the air box 70 and the suction devices 66 to prevent displacement of the sheet downwardly between the suction devices 66 and the air box 70.

As stated hereinabove, the bearing assemblies 54 are longitudinally movable on the machine frame 18 toward and away from the pile 36 to facilitate a change in the position of the suction devices 66 and the upper guide plate 44 relative to the pile 36 for variations in the length of the sheet being printed. Thus, for smaller length sheets the suction wheels 66 and upper guide plate 44 are shifted closer to the pile 36 than the suction wheels 66 and guide plate 44 would be positioned for sheets of greater length. To accommodate a greater length sheet, the bearing assemblies 54 are advanced on the machine frame 18 away from the pile 36.

The movement of the bearing assemblies 54 on the frame 18 is accomplished by an actuating mechanism generally designated by the numeral 82 and illustrated in FIGS. 1, 2, 3 and 7. The actuating mechanism 82 includes a pair of threaded spindles 84 and 86 that are supported on the machine frame 18 opposite the pile 36. The end portion of each spindle, illustrated in detail in FIG. 7, includes nonrotatably secured thereto a bevel gear 88 that is arranged in meshing relation with a bevel gear 90 nonrotatably secured to the opposite ends of a shaft 92 that extends transversely between and is supported on the machine frame 18. The spindles 84 and 86 are rotated by a handwheel 94 selectively positioned to one end portion of the spindle 84 or 86. The bearing assemblies 54 are engaged to the threaded spindles 84 and 86 so that upon rotation of the handwheel 94 in a preselected direction the spindles are rotated and the bearings advance in a preselected direction as determined by the direction of rotation of the handwheel toward or away from the pile 36.

By rotating the handwheel 94 in a clockwise direction, the bearing assemblies 54 are advanced on the spindle away from the pile 36 to move the suction wheels 66 and the guide plate 44 in the same direction to effect delivery of sheets of greater length to the pile 36. Accordingly, rotation of the handwheel in the opposite direction will carry out shifting of the suction wheels 66 and the guide plate 44 toward the pile 36 for delivery of sheets of a smaller length. Not only are the suction wheels 66 and plate member 44 advanced with the bearing assemblies 54 but the air box 70 and the guide plate 80, as well.

Figure 5:
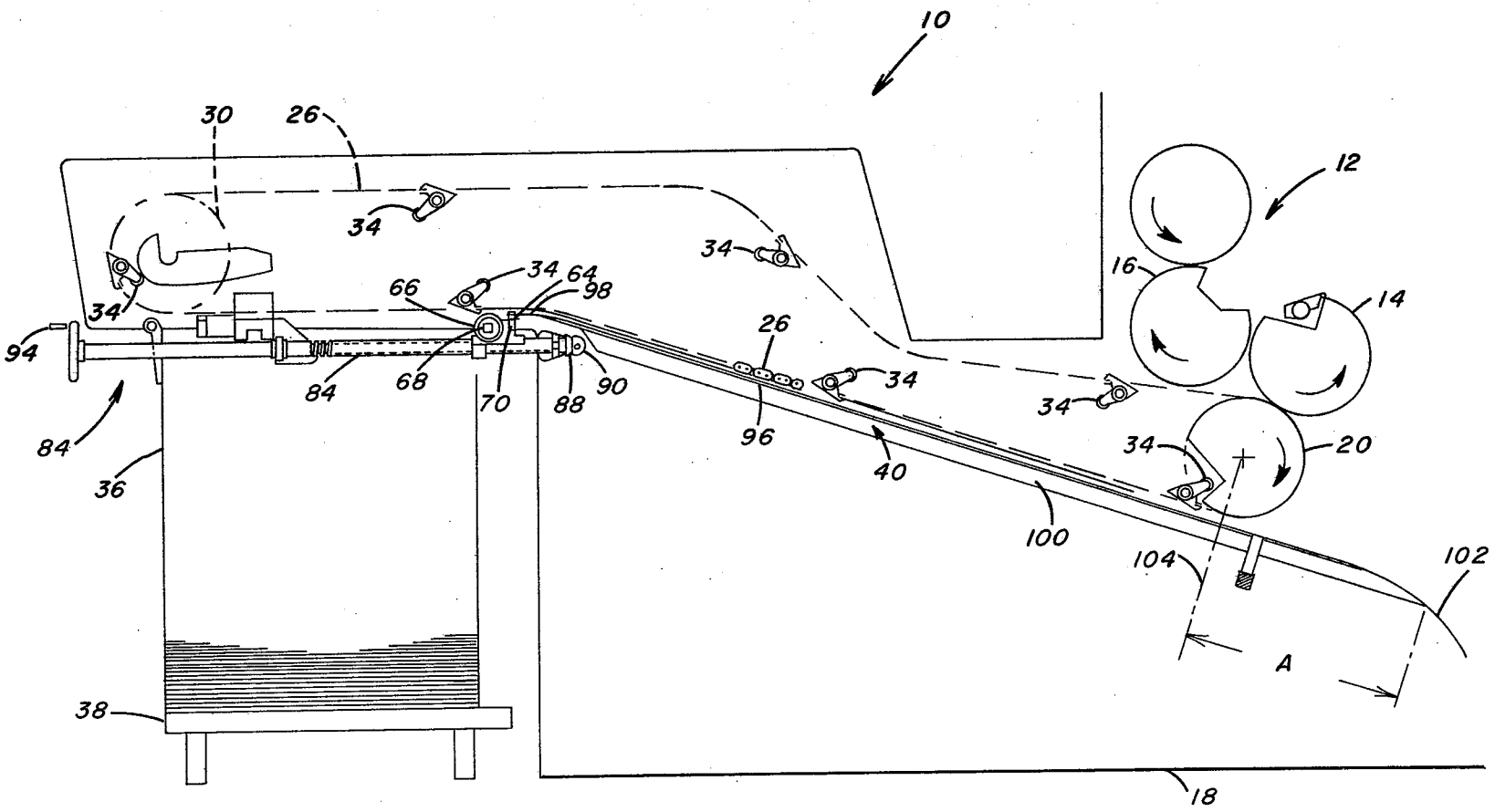
FIG. 5 is a view in side elevation of the sheet delivery mechanism similar to FIG. 4, illustrating a single continuous sheet guide plate adjusted to deliver to the pile of sheets a printed sheet of maximum length.
Figure 6:
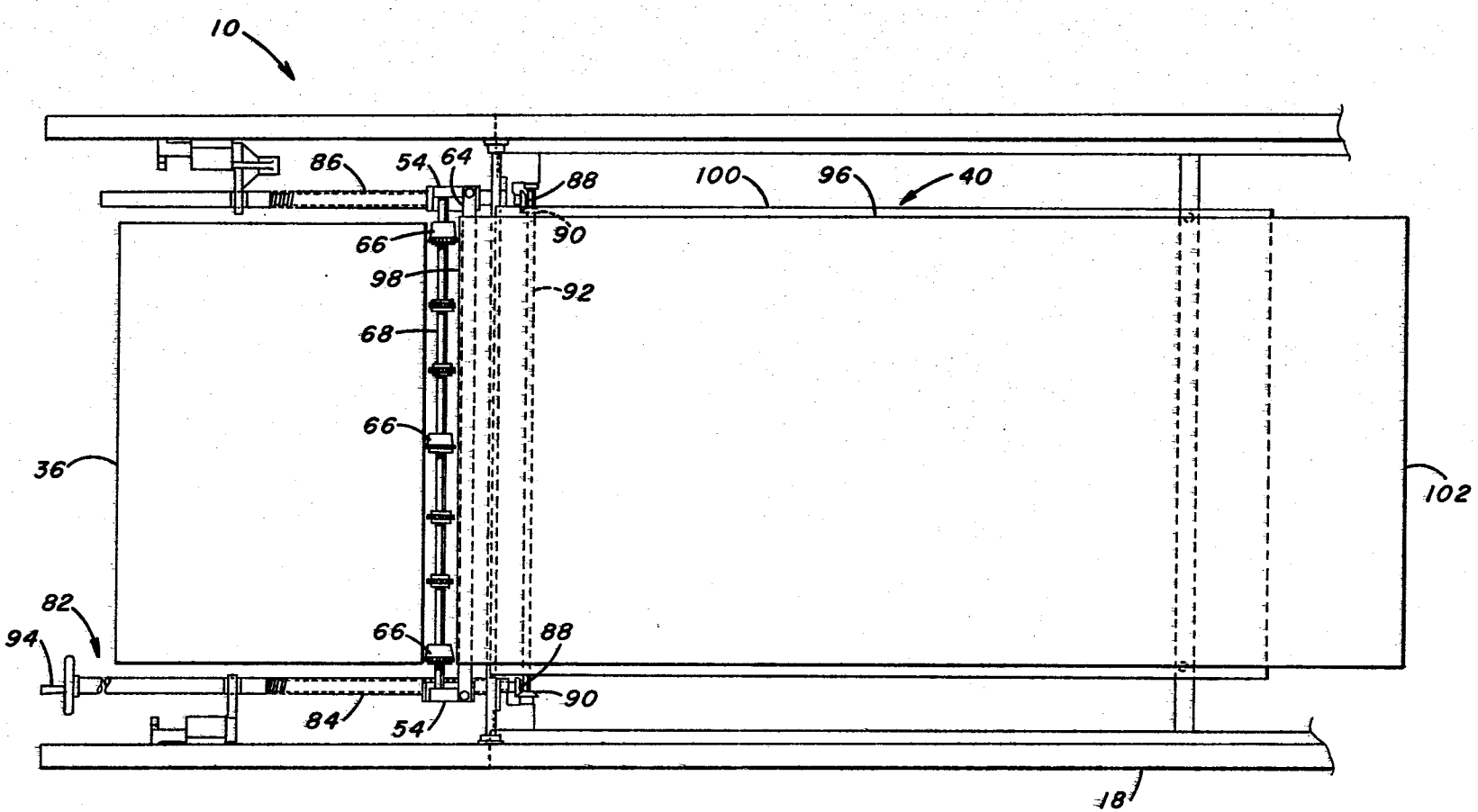
FIG. 6 is a top plan view of the embodiment of the invention illustrated in FIG. 5.

Referring to FIGS. 5 and 6 of the drawings, there is illustrated a second embodiment for the sheet guide assembly 40 of the sheet delivery mechanism 10 that substitutes a single sheet guide plate 96 for the pair of sheet guide plates 42 and 44, illustrated in FIGS. 1–4 and 7. The sheet guide plate 96 of FIGS. 5 and 6 is a continuous and flexible sheet that is secured at upper end portion 98 thereof to the stiffener bar 64, in the manner above described for the connection of sheet guide plate 44 to the stiffener bar 64. The single plate 96 extends rearwardly from a position adjacent the suction wheels 66 on the upper surface of a support plate 100 that is rigidly secured to the frame member 18. The guide plate 96 has a lower end portion 102 that as illustrated in FIG. 5 curves upwardly from a lower position toward the delivery cylinder 20 with the curved end portion 102 hanging freely downwardly from the support plate 100. In this position the sheet guide plate 96 is adjusted for transfer of a sheet of maximum length.

To accommodate the transfer of a sheet of a minimum length the guide plate 96 is advanced toward the pile 36 by movement of the bearing assemblies 54, in the manner above described, so that the end portion 102 rests entirely on the support plate 100 and thereby eliminating the arcuate curve illustrated in FIG. 5. This position on the single sheet guide plate 96 on the support plate 100 is illustrated in FIG. 6. When a sheet of minimum length is being delivered to the pile 36 the plate upper end portion 98 is positioned further from the printing unit 12 than when delivering sheets of maximum length. When the sheet delivery apparatus 10 is delivering sheets of maximum length to the pile 36, the end portion 102 of the plate 96 overhangs the lower end of support plate 100.

As with the embodiment of sheet guide assembly 40 having upper and lower sheet guide plates 42 and 44, movement of a sheet by rotation of the chains 26 and 28 creates a cushion of air between the upper surface of the single guide plate 96 and the lower surface of the sheet so that the sheet floats over the plate 96 out of contact therewith. It will be apparent from the present invention that the distance of the sheet floats above the surface of a sheet guide plate is determined by the position of the grippers on the chains above the surface of the plate 96. To maintain the sheet removed from contact with the plate 96 it is essential that the cushion of air be continuous and not interrupted by a deviation from a uniform surface of the plate 96 such as by an uneveness in the plate surface. Therefore, it is preferred that the flexible plate 96 be a single plate from end portion 98 to end portion 102 having a polished surface. This assures the presence of an uninterrupted air cushion between the plate and the sheet for preventing contact of the sheet with the plate and smearing of the ink prior to drying of the sheet. However, if a single plate of this quality is not available, the pair of sheet guide plates 42 and 44, as above described and illustrated, may be utilized.

As illustrated in FIG. 5, the gripper bars 34 seize the leading edge portion of a sheet which is led around the delivery cylinder 20 as the chains 26 and 28 move the gripper bars in the intended direction of travel of the sheet. Care must be exercised in preventing the trailing edge of the sheet, as it passes around the delivery cylinder 20, from contacting the lower end portion 102 of the single sheet guide plate 96 illustrated in FIG. 5 or the lower end portion of the sheet guide plate 42 illustrated in FIGS. 1–4. To avoid this problem the lower end portion of the respective sheet guide plates 42 and 96 are extended a sufficient distance A from a vertical axis 104 through the axis of rotation of delivery cylinder 20. With this arrangement as the sheet passes around the delivery cylinder 20 with the leading edge portion engaged by the gripper bars 34, the trailing edge portion when moving out of contact with the surface of the delivery cylinder 20 is supported by the air cushion above the respective sheet guide plate to prevent contact of the sheet with the plate.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. Apparatus for delivering individual sequentially supplied sheets of paper or the like from a delivery source to an area for accumulating a pile of such sheets comprising, a stationary support member, conveying means carried by said stationary support member for transporting individual sheets of such supplied sheets through an elongated delivery path from an entrance end to a discharge portion with each such transported sheet being released within said discharge portion in overlying relationship to an area for receiving a pile of such transported sheets, sheet movement retarding means movably carried by said stationary support member and having at least one portion thereof engageable with the trailing edge of each such transported sheet in said discharge portion, said retarding means being selectively movable to vary the length of said delivery path and the location at which said trailing edge of each such transported sheet is engaged in said discharge portion with respect to said entrance end, sheet support means carried by said stationary support member having an elongated surface thereon extending below at least a portion of said delivery path from said entrance end to adjacent said retarding means, said surface being of an extent and spacing with respect to said portion of said delivery path to maintain a cushion of air between said surface and each such transported sheet while moving through said portion of said delivery path, and said sheet support means having at least a portion thereof selectively movable to vary the length of said surface below said portion of said discharge path in conformity with the variations of length of said portion of said delivery path resulting from selectively locating said retarding means and maintain said cushion of air regardless of the location of said retarding means.

2. Apparatus as set forth in claim 1 wherein, the portion of said sheet support means other than said selectively movable portion is stationary.

3. Apparatus as set forth in claim 2 wherein said stationary support member includes means for biasing said portions of said sheet support means into engagement with each other in all relative positions thereof.

4. Apparatus as set forth in claim 1 wherein, said sheet support means is bodily movable and is of a length to maintain said surface below said portion of said discharge path in conformity with the variations of length of said portion of said delivery path resulting from selectively locating said retarding means and maintain said cushion of air regardless of the location of said portion of said conveying means.

5. Apparatus as set forth in claim 1 wherein said sheet support means extends beyond said entrance end in a direction opposite the direction of sheet movement in selected locations of said sheet support means.

6. Apparatus as set forth in claim 1 wherein said surface is continuous and uninterrupted.

7. Apparatus as set forth in claim 1 wherein said portion of said retarding means includes a plurality of suction means engageable with said trailing edge to retard movement of each such transported sheet in said discharge portion.

8. Apparatus as set forth in claim 7 wherein said retarding means includes a fixed support extending transversely of said delivery path and spaced from said suction means, and said sheet support means has the end thereof remote from said entrance end secured to said fixed support.

9. Apparatus as set forth in claim 1 wherein said retarding means includes means for directing air between said surface and each such transported sheet.

10. Apparatus as set forth in claim 1 wherein said sheet support means is a flexible metallic member.

* * * * *